219-121 SR
1/8/85 XR 4,492,873

United States Patent [19]
Dmitriev et al.

[11] Patent Number: 4,492,873
[45] Date of Patent: Jan. 8, 1985

[54] APPARATUS FOR ELECTRON BEAM IRRADIATION OF OBJECTS

[76] Inventors: Stanislav P. Dmitriev, ulitsa Michurinskaya, 19, kv. 23; Andrei S. Ivanov, ulitsa Kuznetsovskaya, 8, kv. 33; Mikhail P. Sviniin, poselok Metallostroi, ulitsa Bogaichuka, 4, kv. 25; Mikhail T. Fedotov, poselok Metallostroi, ulitsa Polevaya, 22, kv. 58, all of Leningrad, U.S.S.R.

[21] Appl. No.: 336,393

[22] PCT Filed: Apr. 25, 1980

[86] PCT No.: PCT/SU80/00065
§ 371 Date: Dec. 21, 1981
§ 102(e) Date: Dec. 21, 1981

[87] PCT Pub. No.: WO81/03104
PCT Pub. Date: Oct. 29, 1981

[51] Int. Cl.[3] ..... H01J 33/02
[52] U.S. Cl. ..... 250/492.3; 219/121 EV; 250/396 ML
[58] Field of Search ..... 250/492.3, 396 ML; 219/121 EV

[56] References Cited

U.S. PATENT DOCUMENTS

| | | | |
|---|---|---|---|
| 3,246,147 | 4/1966 | Skala | 250/492.3 |
| 3,390,249 | 6/1968 | Hanks | 219/121 EV |
| 3,420,977 | 1/1969 | Hanks et al. | 219/121 EV |

FOREIGN PATENT DOCUMENTS 872518 7/1961 United Kingdom .

*Primary Examiner*—Alfred E. Smith
*Assistant Examiner*—T. N. Grigsby
*Attorney, Agent, or Firm*—Lilling & Greenspan

[57] ABSTRACT

An apparatus for electron beam irradiation of objects comprises an electron beam shaper 1 providing a ribbon-shaped beam 7 and a deflecting electromagnet 8 with a frame-type magnetic circuit 9 to direct the beam 7 onto an irradiated object 6 substantially at an angle of 90°. The deflecting electromagnet 8 has two poles 10, 11 extending over the width of the irradiated object 6 and two windings 12, 13 embracing the poles 10, 11 and connected to a direct current source 14, the deflecting electromagnet 8 being arranged so that the trajectories of the electrons within the area from the shaper 1 to the deflecting electromagnet 8 are inclined to the frame of its magnetic circuit 9.

3 Claims, 4 Drawing Figures

APPARATUS FOR ELECTRON BEAM IRRADIATION OF OBJECTS

BACKGROUND OF THE INVENTION

1. Field of the Invention

The present invention relates to accelerator technique, and more particularly to apparatus for electron beam irradiation of objects.

2. Prior Art

When objects are irradiated by charged particles, including electrons, for example, in apparatus for radiation and chemical treatment of materials it is required to provide an irradiation field of considerable extension equal at least to the width of an irradiated object. The whole surface of the object is exposed to irradiation by displacing of the object lengthwise across the irradiation field.

Besides, the irradiation field should be uniform to provide predetermined properties of the irradiated material equal, over the whole surface of irradiation, i.e. it is required to obtain uniform distribution of energy of the charged particles over the surface of the irradiated object to provide equal depth of penetration of the charged particles into the material of the object.

Known in the art are apparatus for electron beam irradiation of objects, wherein shaping of extended irradiation fields is based on scanning of an electron beam, i.e. on displacement of the beam of small cross-sectional area over the irradiated surface by means of its deflection by a time-modulated field, most frequently by a magnetic field. In the apparatus of this type the maximum permissible width of the material to be irradiated depends on the vertical dimension of the vacuum chamber of the apparatus. Thus, for example, in order to sweep the electron beam for 1 meter the vertical dimension of the vacuum chamber should be about 2 meters and further increase in the width of the irradiated objects considerably increases the vertical dimension of the apparatus. If the amount of deflection of an electron beam is increased while maintaining the same height of the vacuum chamber, nonuniformity of the irradiation of the objects over their width occurs due to the fact that the angle of incidence of electrons onto the objects at the extreme positions of the beam will be substantially different from the right angle corresponding to the electron trajectory at the central beam position.

Known in the art is an apparatus for electron beam irradiation of objects (Cf. FRG Application No. 2,901,056 published 1979), comprising an electron beam shaper, a deflecting electromagnet with a frame-type magnetic circuit to direct the electron beam to the irradiated object substantially at an angle of 90°, and a vacuum chamber to transport the electron beam from the shaper through the magnetic circuit and further through an exit window of the vacuum chamber onto the surface of the irradiated object, the deflecting magnet being located wherever necessary either outside the vacuum chamber embracing the latter, or inside the vacuum chamber. The electromagnet has a number of windings arranged at its poles and geometrically displaced relative to one another along the poles. The electromagnet windings are connected in turn to a supply source through a commutator, whereby the field of the electromagnet moves in the direction of the line equidistant to the surface of the irradiated object.

The apparatus according to the abovementioned FRG Application eliminates the drawbacks inherent in the apparatus, using the scanning of an electron beam, i.e. it can provide a uniform irradiation field of practically any desirable extension without increase in the height of the apparatus owing to horizontal arrangement of the electron beam shaper and the vacuum chamber. However, operation of the deflecting magnet under alternating field conditions results in the following complications in the apparatus design:

use of laminated magnetic circuit in the deflecting electromagnet;

use of a special commutation circuit for connecting the electromagnet windings to the supply source, provided with a commutator control circuit;

when the deflecting magnet is arranged outside the vacuum chamber the latter should either have sufficiently thin walls (0.3–0.5 mm) of stainless steel, said walls being obligatory corrugated like belows to provide its mechanical strength, or it should be made of dielectric such as, for example, ceramics;

when the deflecting magnet is arranged inside the vacuum chamber it is necessary to keep the low level of gas release within the volume of the vacuum chamber from the laminated magnetic circuit of the electromagnet and its windings, this being achieved by baking said assemblies in epoxy or other low gassing compounds with mineral fillers.

SUMMARY OF THE INVENTION

The principal object of the present invention is to provide an apparatus for electron beam irradiation of objects, wherein an electron beam shaper and a deflecting electromagnet should be made such as to simplify the design of the whole apparatus and to ensure uniform irradiation of flat objects of any width to be met with in practice.

With this principal object in view, there is provided an apparatus for electron beam irradiation of objects, comprising an electron beam shaper and a deflecting electromagnet with frame-type magnetic circuit to direct an electron beam onto the irradiated object substantially at an angle of 90°, wherein, according to the invention, the electron beam shaper is made such as to provide a ribbon-shaped electron beam, the deflecting electromagnet is made two-poled, the poles extending over the width of the irradiated object, and comprises two windings embracing said poles and connected to a direct current source, the deflecting electromagnet being arranged so that the trajectories of the electrons within the area from the shaper to the deflecting electromagnet are inclined to the plane of the frame of its magnetic circuit.

Two-pole deflecting electromagnet having the poles whose length corresponds to the width of the irradiated object and herein proposed arrangement of the windings relative to the poles provides uniform and stationary magnetic field in the aperture of the electromagnet, whereby all the electrons in the beam impinge onto the irradiated object at an equal angle making the irradiation field uniform over the whole width of the irradiated object. Due to inclination of the plane of the magnetic circuit frame of the electromagnet to the trajectories of the electrons constituting the field produced by the electromagnet, i.e. to the longitudinal axis of the shaper, the ribbon-shaped electron beam of the initial width provided by the shaper is transformed into a wider beam while maintaining sufficient uniformity of the electron distribution over the beam cross-section, thus making it possible to obtain suitably extended irradiation field with a reasonable height of the apparatus.

In the proposed apparatus the design of a number of assemblies is simplified, i.e. of a vacuum chamber, which can be made as a thick-walled vacuum chamber of a conventional type, and of a deflecting electromagnet whose magnetic circuit can be made all-metal, the electromagnet supply circuit being simplified as well.

According to one embodiment of the present invention the electron beam shaper comprises an electron gun with an extended cathode and an accelerating tube providing acceleration of the ribbon-shaped electron beam.

In this case the shaping of the ribbon electron beam is provided by the shaper comprising minimum number of elements.

According to another embodiment of the present invention the electron beam shaper comprises an electron gun with a point cathode, an accelerating tube, an electron beam sweeping electromagnet, and a correcting electromagnet arranged along the path of the electrons next to a sweeping electromagnet for orientation of the electron trajectories in the direction coinciding with their direction at the exit from an accelerating tube.

In this case the electron beam shaper can comprise the elements whose manufacturing process is well developed in the accelerator technique.

The present invention will subsequently be more apparent from the detailed description of its embodiments taken in conjunction with the accompanying drawings, in which:

DESCRIPTION OF THE PREFERRED EMBODIMENTS

Figure 1:
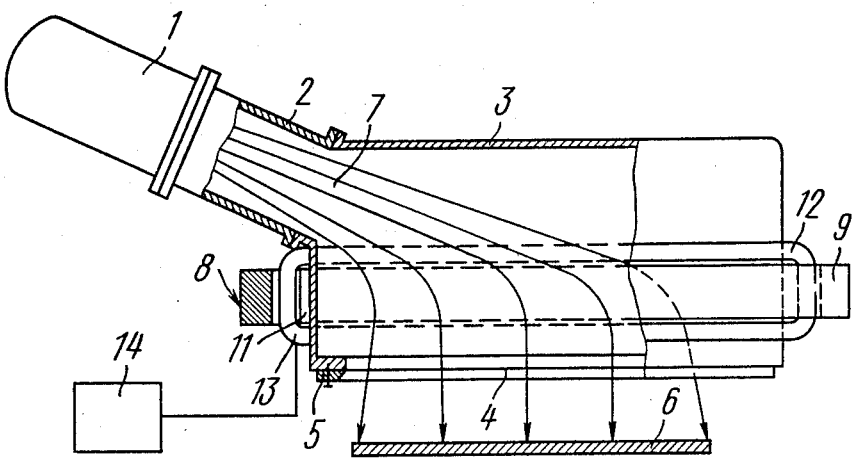
FIG. 1 is a side view of an apparatus for electron beam irradiation of objects, according to the invention, with a partial cross-section of a vacuum chamber and a deflecting electromagnet.

The apparatus for electron beam irradiation of an objects comprises an electron beam shaper 1 (FIG. 1) connected through an electron conduit 2 with a vacuum chamber 3 provided with an exit window 4 made of a foil and fixed on the vacuum chamber 3 with a flange 5. Located under the exit window 4 is an object 6 to be irradiated by electrons, e.g. a film, a lacquer coating or a cloth. According to the invention, the shaper 1 provides, by one of the particular ways described below, a ribbon-shaped electron beam 7, i.e. such a beam one of whose cross-sectional dimensions is many times more than its other dimension. In FIG. 1 the greatest dimension of the cross-section of the electron beam lies in the plane of the drawing, whereas the smallest dimension lies in the direction perpendicular to the plane of the drawing. FIG. 1 shows the electron beam shaper 1 schematically, i.e. it does not show the elements constituting this shaper forming the ribbon-shaped electron beam, and the beam 7 itself is shown slightly diverging in the vertical plane, that corresponds to the most general case of shaping of electron beams, including ribbon-shaped electron beams, wherein natural divergence is not eliminated, or to the scanning at a small angle ($\pm 5°$) of the focused electron beam.

The apparatus comprises also an electromagnet 8 with a frame-type magnetic circuit 9, embracing the vacuum chamber 3 and designed to direct the electron beam shaped by the shaper 1 to the irradiated object 6 at an angle of 90°. According to the invention, the deflecting electromagnet 8 is arranged so that the electron trajectories within the area extending from the shaper 1 to the deflecting electromagnet 8 be inclined to the plane of the frame of its magnetic circuit 9. The deflecting electromagnet 8 has two poles 10 (FIG. 2) and 11 arranged along the long sides of the magnetic circuit 9, and two windings 12 and 13 embracing the poles 10 and 11 respectively, and connected electrically in series and in accordance. The windings 12 and 13 are connected to a direct current source 14 (FIG. 1). The length of the poles 10 (FIG. 2) and 11 is slightly greater than the maximum width of the irradiated object 6, to be met with in practice.

Figure 2:
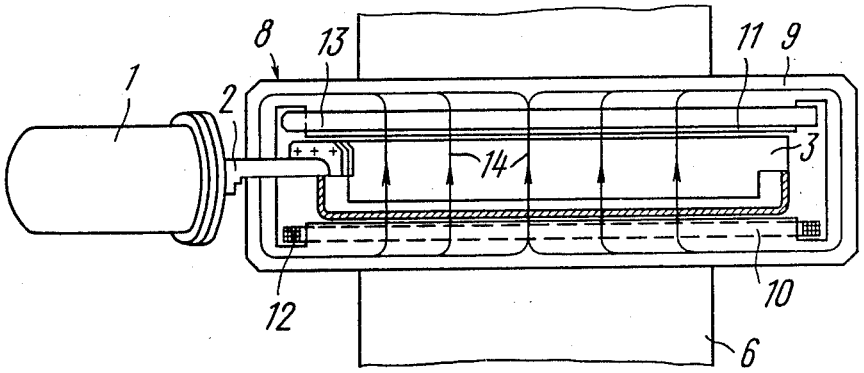
FIG. 2 is a top view of the apparatus shown in FIG. 1.

Though FIG. 2 shows the deflecting magnet 8 with salient poles 10 and 11 it is evident that the poles of the electromagnet 8 may not be salient, i.e. the magnetic circuit 9 may not have inward projections, the poles of the electromagnet 8 being formed in that case by the parts of the magnetic circuit situated between each of the windings 12 and 13.

Figure 3:
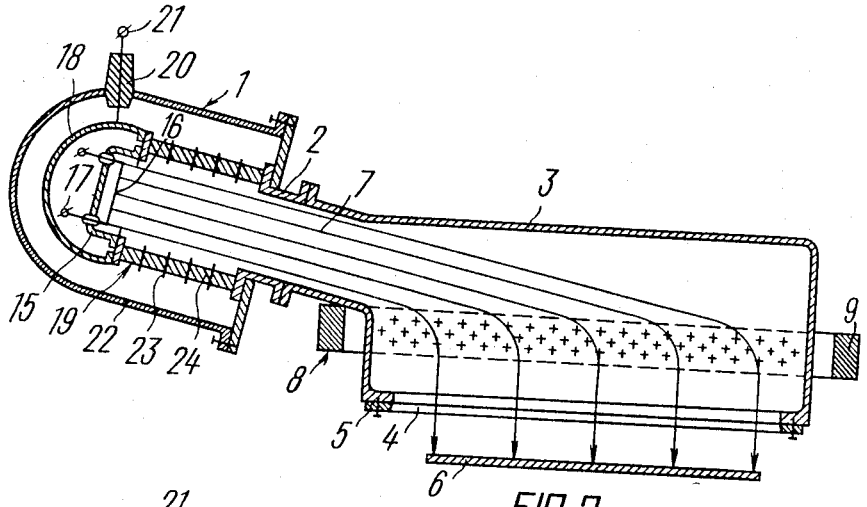
FIG. 3 shows one embodiment of an electron beam shaper of the apparatus shown in FIGS. 1 and 2 according to the invention.

FIG. 3 illustrates one of the embodiments of the proposed apparatus, the deflecting electromagnet 8 being schematically shown in the form of a triangle limiting the zone of the magnetic field produced by the electromagnet, whose lines of force are perpendicular to the plane of the drawing and are designated by the crosses. According to this embodiment the electron beam shaper comprises an electron gun 15 with an extended heated cathode 16 supplied with the heat current through terminals 17. The electron gun 15 is arranged inside a highvoltage electrode 18 coupled to an accelerating tube 19 and connected electrically via through insulator 20 and a terminal 21 to an accelerating-voltage source (not shown). The accelerating tube 19 with the electron gun 15 is arranged inside a sealed housing 22 filled with electroinsulating medium, for example, transformer oil.

The accelerating section of the accelerating tube 19, consisiting of electrodes 23 and insulators 24, has such an outline in the cross-section perpendicular to the beam 7, that it provides acceleration of the ribbon-shaped beam 7 produced by the extended cathode 16 with practically parallel electron trajectories.

Figure 4:
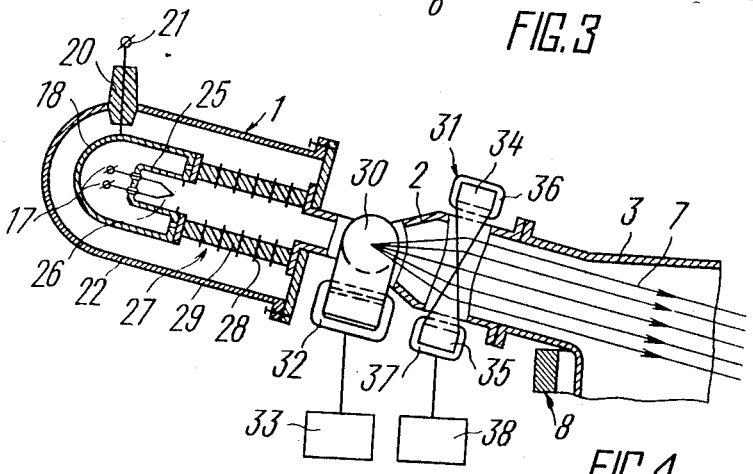
FIG. 4 shows another embodiment of an electron beam shaper of the apparatus shown in FIGS. 1 and 2.

FIG. 4 shows another embodiment of the proposed apparatus, wherein the electron beam shaper 1 comprises an electron gun 25 with a point cathode 26, and an accelerating tube 27 with such an outline of the accelerating electrodes 28 and insulators 29 which provides acceleration of the electron beam focused in the cross-section produced by the point cathode 26. In other words, the accelerating tube 27 presents in this particular case a well known type of accelerating tube with circular accelerating electrodes and insulators widely used in the accelerator technique. In order not to complicate the drawing a part of the vacuum chamber 3, the deflecting electromagnet and the irradiated object are not shown in FIG. 4.

The electron beam shaper 1 also comprises a sweeping electromagnet 30 arranged on the electrone conduit 2, and a correcting electromagnet 31 located along the path of the electrons next to the sweeping electromagnet 30. Windings 32 of the sweeping electromagnet 30 are connected to a sweep current generator 33. The correcting electromagnet has two pairs 34 and 35 of wedge shaped poles, the windings 36 and 37 of the correcting electromagnet 31 being connected electrically in series and in opposition and coupled to a direct current source 38. The correcting electromagnet 31 is used to change the direction of the electrons deflected by the sweeping electromagnet 30 so that the trajectories of all the electrons in the beam 7 be parallel to their initial trajectory at the exit from the accelerating tube 27.

The proposed apparatus operates as follows.

The shaper 1 (FIG. 1) provides the ribbon-shaped electron beam slightly diverging in the vertical plane. When the current flows from the source 14 through the windings 12 and 13 of the electromagnet 8 the stationary uniform magnetic field is excited within the interpole space thereof, the lines of force of said field piercing through the vacuum chamber 3 in the direction perpendicular to the plane of the electron beam 7. The direction of the lines of force of the field of the electromagnet 8 is shown in FIG. 2 by arrows.

The electrons incident to this magnetic field move circlewise, the radius of this circle being determined by their energy and the intensity of the magnetic field, and are deflected from their initial trajectories in the direction to the irradiated object 6, the uniformity of the distribution of the electrons over the cross-section of the beam 7 being kept equal to the uniformity of the initial ribbon beam shaped by the shaper 1. By adjusting of the exciting current flowing through the windings 12 and 13 of the electromagnet 8, the width of its poles 10 and 11 (FIG. 2) and electron energy being pre-assigned, the direction of the central trajectories in the beam 7 (FIG. 1) to the irradiated object at an angle of 90° is obtained. It is evident that divergence of electrons in the beam 7 will remain also after the deflection thereof by the magnet 8, as a result of which the extreme electrons in the beam 7 will strike the irradiated object at an inclined direction, but since the divergence of the electron trajectories in the beam does not exceed ±5° this inclination is small enough and practically does not affect the uniformity of irradiation of the objects. Therefore, it may be considered to be sufficiently accurate for practice, that the electrons fall onto the irradiated object 6 at an angle of 90°.

The deflection of the trajectories of the electrons produced by the electromagnet 8 results in the increase in the width of the ribbon-shaped beam 7 from relatively small dimension limited by the constructional peculiarities of the elements of the shaper 1 to the width of the irradiated object 6.

In the embodiment shown in FIG. 3 the shaper 1 forms a ribbon-shaped electron beam 7 with practically parallel trajectories of the electrons, the width of the electron beam 7 being equal to the length of the cathode 16. In this case all the electron trajectories have the same inclination to the plane of the aperture of the electromagnet 8 and will be deflected onto the object in an identical way.

The apparatus, as best shown in FIG. 4, operates in a similar mode, except for the fact that at the exit of the accelerating tube 27 there is formed a "linear", i.e. focused in the cross-section, beam which is scanned by an alternating magnetic field generated by the sweeping electromagnet 30 within the aperture of the correcting electromagnet 31. Between each pair 34 and 35 of the poles of the electromagnet 31 a stationary magnetic field is excited whose intensity decreases towards the center of the beam, the direction of the lines of force of the magnetic field between the poles 34 being opposite to the direction of the lines of force of the magnetic field between the poles 35. Due to such an outline of the field of the correcting electromagnet 31 the electrons far removed from the center of the beam are deflected by the electromagnet 31 to a greater angle, and the electrons on different sides from the centre of the beam are deflected in different directions, whereby the trajectories of all the electrons passed through the field of the correcting electromagnet 31 are found to be parallel to one another and to their initial trajectory at the exit from the accelerating tube 27.

COMMERCIAL APPLICABILITY

The present invention may be used in radiation and chemical tecknology when designing the apparatus for different kinds of tecknological processes: treatment of polymeric films, lacquer coatings, textile materials. The invention allows to design an apparatus with better weight-to-dimension parameters providing the possibility of using local biological protection of the apparatus. It has to be noted herewith that such apparatus can be used without any special measures in the rooms, wherein technological operations not connected with radiation treatment are carried out.

The advantage of the invention as compared to known apparatus of similar designation is in combination of such properties as the simplicity in construction and small height (1.5 meter) thereof, which substantially facilitates the operation of the apparatus. The apparatus in accordance with the invention can irradiate the objects of any width to be met with in practice with sufficient radiation doze homogeneity.

We claim:

1. An apparatus for an electron beam irradiation of objects, comprising an electron beam shaper and a deflecting electromagnet with a frame-type magnetic circuit to direct the electron beam onto an irradiated object substantially at an angle at 90°, characterized in that the electron beam shaper 1 is made such as to provide a ribbon-shaped electron beam 7, the deflecting electromagnet 8 having two-poles 10, 11, said poles extending over the whole width of the object 6, and comprises two windings 12, 13 embracing said poles 10, 11 and connected to a direct current source 14, the deflecting electromagnet 8 being arranged so that the trajectories of the electrons within the area from the shaper 1 to the deflecting electromagnet 8 are inclined to the plane of the frame of its magnetic circuit 9, and wherein the electron beam shaper 1 comprises an electron gun 15 with an extended cathode 16 and an accelerating tube 19 providing acceleration of the ribbon-shaped electron beam.

2. An apparatus as set forth in claim 1, further comprising a correcting electromagnet 31 located along the path of the electrons next to the sweeping electromagnet 30 to orient the trajectories of the electrons in the direction coinciding with their direction at the exit from the accelerating tube 27.

3. An apparatus for irradiation, comprising an electron beam shaper and a deflecting electromagnet with a frame-type magnetic circuit to direct the electron beam onto an irradiated object substantially at an angle of 90°, the electron beam shaper is made such as to provide a ribbon-shaped electron beam, and the deflecting electromagnet has two poles, said poles extending over the whole width of the irradiated object and comprises two windings connected to a direct current source, the deflecting electromagnet being arrangeed so that the trajectories of the electrons within the area from the shaper to the deflecting electromagnet are inclined to the plane of the frame of its magnetic circuit, characterized in that the electron beam shaper (1) comprises an electron beam (25) with a point cathode (26), an accelerating tube (27) and an electron beam sweeping electromagnet (30).

* * * * *